United States Patent [19]

Haufe et al.

[11] Patent Number: 4,980,125

[45] Date of Patent: Dec. 25, 1990

[54] SINTER CONTACT MATERIAL FOR LOW VOLTAGE SWITCHING APPARATUS OF THE ENERGY TECHNOLOGY, IN PARTICULAR FOR MOTOR CONTACTORS

[75] Inventors: Wolfgang Haufe, Hessdorf; Ralf-Dieter Krause, Nuremberg; Bernhard Rothkegel, deceased, late of Nuremberg, all of Fed. Rep. of Germany, by Rita G. Rothkegel, Bianca Rothkegel, Matthias Rothkegel, heirs

[73] Assignee: Siemens Aktiengesellschaft, Berlin & Munich, Fed. Rep. of Germany

[21] Appl. No.: 438,740

[22] Filed: Nov. 17, 1989

[30] Foreign Application Priority Data

Nov. 17, 1988 [DE] Fed. Rep. of Germany ..... 3838950

[51] Int. Cl.[5] ..... B22F 1/00

[52] U.S. Cl. ..... 419/21; 419/22; 75/234; 252/520

[58] Field of Search ..... 419/21, 22; 75/234; 252/514, 518, 520

[56] References Cited

U.S. PATENT DOCUMENTS

| | | | |
|---|---|---|---|
| 4,141,727 | 2/1979 | Shida et al. | 75/232 |
| 4,565,590 | 1/1986 | Grosse et al. | 148/431 |
| 4,609,525 | 9/1986 | Schreiner | 419/6 |
| 4,681,702 | 7/1987 | Schreiner et al. | 252/518 |
| 4,764,227 | 8/1988 | Rothkegel et al. | 148/431 |
| 4,855,104 | 8/1989 | Rothkegel et al. | 419/28 |

FOREIGN PATENT DOCUMENTS

| | | |
|---|---|---|
| 3304637 | 8/1984 | Fed. Rep. of Germany . |
| 3421758 | 12/1985 | Fed. Rep. of Germany . |
| 3421759 | 12/1985 | Fed. Rep. of Germany . |

*Primary Examiner*—William R. Dixon, Jr.
*Assistant Examiner*—Chris Gallo
*Attorney, Agent, or Firm*—Kenyon & Kenyon

[57] ABSTRACT

Sinter materials having the constitution $AgSnO_2Bi_2O_3$-CuO produced from an intraoxidized alloy powder have added thereto bismuth zirconate and/or bismuth titanate in parts by weight of preferably between 0.1 and 5%. For the production of these materials, bismuth zirconate and/or bismuth titanate is added as a separate powder to the intraoxidized alloy powder of $AgSnO_2$-$Bi_2O_3CuO$. With such a contact material, the excess temperature behavior in motor contactors is significantly improved.

7 Claims, 1 Drawing Sheet

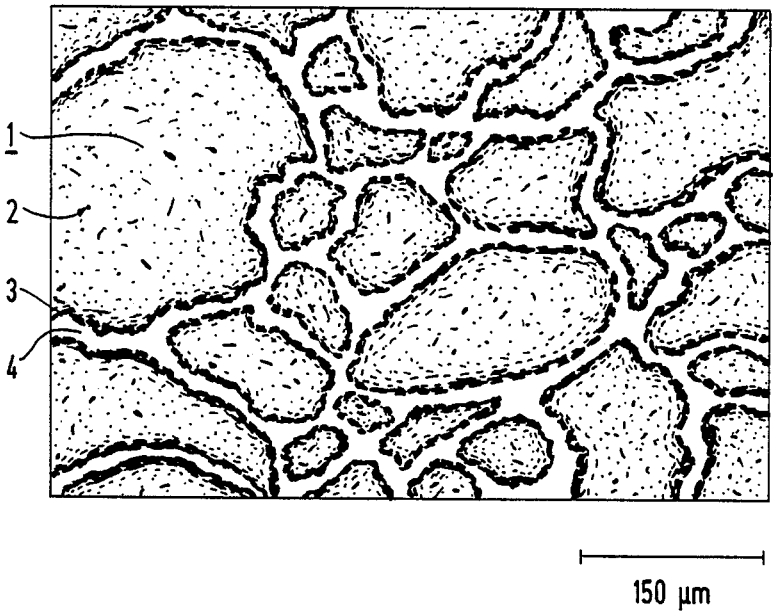
1
2
3
4
150 µm

SINTER CONTACT MATERIAL FOR LOW VOLTAGE SWITCHING APPARATUS OF THE ENERGY TECHNOLOGY, IN PARTICULAR FOR MOTOR CONTACTORS

FIELD OF THE INVENTION

This invention relates to a sinter contact material for low voltage switching apparatus of the energy technology, in particular for motor contactors, containing silver (Ag), tin oxide ($SnO_2$), bismuth oxide ($Bi_2O_3$), and copper oxide (CuO), and produced from an intraoxidized alloy powder (IOAP) of the metals silver, tin, bismuth, and copper. The tin oxide is present in parts by weight of from 4 to 12% and the ratio of the parts by weight of tin oxide to bismuth oxide, on the one hand, and of tin oxide to copper oxide in the intraoxidized alloy powder, on the other hand, is in each instance between 8:1 and 12:1.

BACKGROUND OF THE INVENTION

Contact materials based on silver-tin oxide have proven to be particularly advantageous for use in low voltage switching apparatus of the energy technology, for example, in motor contactors and also in power switches. Contact pieces of silver-tin oxide in motor contactors have a long lifetime number of operations, but have the disadvantage that, under the influence of arcing, oxide layers form on the contact surfaces which are thermally very stable leading to an increased contact resistance. Therefore, when carrying continuous current in the switching apparatus, unacceptably high excess temperatures occur at the switching members which can lead, in particular, to damage at the synthetic parts.

In DE-OS No. 33 04 637, DE-OS No. 34 21 758, and DE-OS No. 34 21 759, sinter contact materials having the constitution $AgSnO_2Bi_2O_3CuO$ are described which, on the one hand, meet the requirements made for lifetime number of operations and, on the other hand, of switching-on capacity. In these materials, a relatively high bismuth oxide fraction can be present which is introduced either via the intraoxidized alloy powder or via a separate addition of the bismuth oxide to the intraoxidized alloy powder. However, with respect to excess temperature, these materials reach acceptable values only if the total parts by weight of the oxide is limited from 8% to 11%.

OBJECT OF THE INVENTION

It is therefore an object of the present invention to provide a contact material produced from intraoxidized alloy powder having the constitution $AgSnO_2Bi_2O_3$-CuO wherein for the purpose of saving silver, the oxide fraction is as high as possible, and nevertheless, the excess temperature is as low as possible and wherein the remaining properties are still in an optimal relationship to each other.

These and other objects of the present invention will become apparent from the description and claims in conjunction with the drawing.

SUMMARY OF THE INVENTION

According to the present invention, a contact material of intraoxidized alloy powder of the $AgSnO_2Bi_2O_3$-CuO type previously described under the heading Field of the Invention further contains bismuth zirconate ($2Bi_2O_3.3ZrO_2$) and/or bismuth titanate ($Bi_2Ti_2O_7$).

Suitably, the bismuth zirconate and/or the bismuth titanate is/are present partially as a mixed oxide or as stoichiometric compound. The fraction by weight of bismuth zirconate and/or bismuth titanate is preferably between 0.1 and 5%, more preferably between 0.5 and 4%, and yet more preferably between 0.5 and 3%. Suitably, the total content of the oxides in parts by weight is maximally 20%, suitably between about 12 and 20%.

For the production of such a material bismuth zirconate powder and/or bismuth titanate powder is added to an intraoxidized alloy powder of given composition, wherein during the wet mixing of the intraoxidized alloy powder with the powder of the added oxides, organic solvents, in particular propanol, are used.

In accordance with the invention, it was surprisingly found that specifically through the addition of bismuth zirconate powder and/or bismuth titanate powder to an intraoxidized alloy powder of $AgSnO_2Bi_2O_3CuO$, relative to the state of the art of a high lifetime number of operations, a lowering of the excess temperature is achieved.

Further details and advantages of the present invention will be evident from the following specification describing a method for the production of contact pieces of the material of the present invention wherein reference is made to the single figure of the drawing to a table with individual examples for different material compositions.

BRIEF DESCRIPTION OF THE DRAWING

The single figure shows a typical diagram of the structural composition of the material of the present invention.

The Table lists measured values for the lifetime number of operations and for the excess temperature.

DETAILED DESCRIPTION

It is known that the lifetime number of operations corresponds to the volume consumption of the contact material and the excess temperature to the contact resistance. Four examples of the state of the art and five embodiment examples of the present invention are compared.

For the production of the intraoxidized alloy powder for the examples given in the Table alloys of AgSnBiCu are melted at a temperature of approximately 1323 K. (1050° C.). By atomization of the melt with water in a pressure atomizing installation, composite alloy powders are directly obtained therefrom. After drying, the powders are sifted to <300 um. This fraction is quantitatively intraoxidized in an oxygen-containing atmosphere at temperatures between 773 K. (500° C.) and 873 K. (600° C.) whereupon $AgSnO_2Bi_2O_3CuO$ powder of the following composition in percentile parts by weight are obtained:

| Example | Ag | $SnO_2$ | $Bi_2O_3$ | CuO |
|---|---|---|---|---|
| 1 | 88.84 | 9.3 | 0.93 | 0.93 |
| 2 | 90.40 | 8.0 | 0.80 | 0.80 |
| 3 | 92.20 | 6.5 | 0.65 | 0.65 |
| 4 | 90.28 | 8.1 | 0.81 | 0.81 |
| 5 | 91.00 | 7.5 | 0.75 | 0.75 |

To these $AgSnO_2Bi_2O_3CuO$ powders are added powders of bismuth zirconate ($2Bi_2O_3ZrO_2$) and/or bismuth titanate ($Bi_2Ti_2O_7$) by wet mixing in an agitator ball mill using propanol and steel balls. After drying the mixture, the steel balls are separated from the particular powder mixture by sifting. The starting powders for the contact piece production of the material examples given in the Table have the following composition:

| | |
|---|---|
| 1. $AgSnO_2 9.3\ Bi_2O_3 0.93\ CuO 0.93 + 2Bi_2O_3.3ZrO_2 1.0$ | IOAP-PM |
| 2. $AgSnO_2 8.0\ Bi_2O_3 0.80\ CuO 0.80 + 2Bi_2O_3.3ZrO_2 2.0$ | IOAP-PM |
| 3. $AgSnO_2 6.5\ Bi_2O_3 0.65\ CuO 0.65 + 2Bi_2O_3.3ZrO_2 2.3$ | IOAP-PM |
| 4. $AgSnO_2 8.1\ Bi_2O_3 0.81\ CuO 0.81 + Bi_2Ti_2O_7 2.0$ | IOAP-PM |
| 5. $AgSnO_2 7.5\ Bi_2O_3 0.75\ CuO 0.75 + 2Bi_2O_3.3ZrO_2 1.6 + Bi_2Ti_2O_7 0.8$ | IOAP-PM |

(IOAP=intraoxidized alloy powder; PM=powder mixture)

In this listing, the intraoxidized alloy powder forms the basis with 100 parts by weight in percent, to which the added oxides in parts by weight relative to 100% are added. In the production of the contact pieces, the manufactured starting powder mixture is compressed with a pressing pressure of, for example, 600 MPa and the thus obtained pressed pieces are sintered at a temperature between 1123 K. (850° C.) and 1148

K (875 C) for 2 hours in air. To achieve a low residual porosity, the sintered contact pieces are repressed warm at a temperature of 923 K. (650° C.) and a pressure of, for example, 1000 MPa. Further compression and solidification is achieved through a second sintering at a temperature between 1123 K. (850° C.) and 1148 K. (875° C.) for a period of 2 hours. Subsequently, as a last production step, a cold calibration to the final form at a pressure of, for example, 1000 MPa takes place.

With the above materials, after the sintering, a specific structure with different oxide particle sizes and shapes as well as oxide concentrations is obtained which is reproduced in the Figure from a (light) microscope structural picture. It is possible to recognize the former particles of the intraoxidized alloy powder 1 with the fine oxide precipitate 2 and the added coarser oxide precipitates 3. Through the regenerative annealing of the oxide precipitates at the borders of the intraoxidized alloy powder of $AgSnO_2Bi_2O_3CuO$, an encompassing nearly oxide-free silver network 4 originates which effects a high sintering compression and which due to its ductility, allows the production of a nearly pore-free contact material through cold compression.

The regenerative annealing which is controllable through the sintering temperature and sintering duration, extends as a front into the interior of the $AgSnO_2$-$Bi_2O_3CuO$ powder particles 1. The oxide precipitates 2 in this front have an oblong partially streak-like shape and contain a high amount of zirconate and/or titanate.

Surprisingly, the structure according to the Figure leads to a favorable influence of the electrical conductivity of the oxide layers forming on the contact surfaces under the influence of arcing.

For use as contact pieces in low voltage switching apparatus of the energy technology, advantageously two-layer finished formed pieces with a solderable pure silver layer are produced. These formed pieces can be soldered directly on the contact carrier, for example, of motor contactors.

With the contact pieces produced according to the above procedure, lifetime and heating tests in motor contactors were carried out. Siemens contactors with a nominal AC-3 operating current of 250 A were used. Significant parameters therein are the lifetime number of operations at the four-fold nominal AC-3 operating current ($4 \times I_{e\ AC\text{-}3} = 1000$ A) and the maximum excess temperature of the connector rails of the switching apparatus when carrying permanently the nominal AC-1 operation current of $I_{e\ AC\text{-}1} = 300$ A. Measurements of the excess temperature were carried out during the lifetime testing up to a number of operations of $5 \times 10^4$. The associated measured values are reproduced in the Table.

The four comparison materials in accordance with the state of the art, which were produced through sintering of intraoxidized alloy powders, are listed first in the Table. The measured values show that with respect to excess temperature, materials of the constitution $AgSnO_2Bi_2O_3CuO$ and $AgSnO_2Bi_2O_3CuO + Bi_2O_3$ do not reach values below 80 K. which in practice is, in many cases, considered to be unsatisfactory.

The new materials of the present invention produced by sintering of an intraoxidized alloy powder with the addition of bismuth zirconate powder and/or bismuth titanate powder, in particular with a total fraction of oxide of approximately 12% by weight, supply the required improvement of the excess temperature behavior. Values of 60 K. to 70 K. were measured with the lifetime number of operations remaining on the same high level as that of the state of the art. Therefore the properties of the contact material are improved overall and in addition, a saving of silver results.

TABLE

| Example No. | Material | | Lifetime Number of Operations at $4 \times I_{e\ AC\text{-}3} = 1000$ A | Excess Temperature in K at $I_{e\ AC\text{-}1} = 300$ A |
|---|---|---|---|---|
| Comparison Material | | | | |
| DE-OS 33 04 637 | $AgSnO_2 10Bi_2O_3 1CuO 1$ | IOAP | ca. 140,000 | 90–120 |
| DE-OS 34 21 759 | $AgSnO_2 6.5Bi_2O_3 0.66CuO 0.74$ | IOAP | ca. 90,000 | 80–90 |
| | $AgSnO_2 6.47Bi_2O_3 3.51CuO 0.71$ | IOAP | ca. 120,000 | 80–90 |
| DE-OS 34 21 758 | $AgSnO_2 6.33Bi_2O_3 0.64CuO 0.72 + Bi_2O_3 2.63$ | IOAP-PM | ca. 120,000 | 80–90 |
| Materials according to the invention | | | | |
| 1. | $AgSnO_2 9.3Bi_2O_3 0.93CuO 0.93 + 2Bi_2O_3.3ZrO_2 1.0$ | IOAP-PM | ca. 125,000 | 60–70 |
| 2. | $AgSnO_2 8Bi_2O_3 0.8CuO 0.8 + 2Bi_2O_3.3ZrO_2 2.0$ | IOAP-PM | ca. 140,000 | 60–70 |
| 3. | $AgSnO_2 6.5Bi_2O_3 0.65CuO 0.65 + 2Bi_2O_3.3ZrO_2 2.3$ | IOAP-PM | ca. 123,000 | 60–70 |
| 4. | $AgSnO_2 8.1Bi_2O_3 0.81CuO 0.81 + Bi_2Ti_2O_7 2.0$ | IOAP-PM | ca. 130,000 | 60–70 |
| 5. | $AgSnO_2 7.5Bi_2O_3 0.75CuO 0.75 + 2Bi_2O_3.3ZrO_2 1.6 + Bi_2Ti_2O_7 0.8$ | IOAP-PM | ca. 135,000 | 60–70 |

What is claimed is:

1. In a sinter contact material containing silver (Ag), tin oxide ($SnO_2$), bismuth oxide ($Bi_2O_3$), and copper oxide (CuO), and produced from an intraoxidized alloy powder of the metals silver, tin, bismuth, and copper wherein the tin oxide is contained in parts by weight of from 4 to 12% and the ratio of the parts by weight in percent of tin oxide to bismuth oxide is between 8:1 to 12:1 and tin oxide to copper oxide is between 8:1 to 12:1 in the intraoxidized alloy powder the improvement comprising:

a member selected from the group consisting of bismuth zirconate ($2Bi_2O_3.ZrO_2$), bismuth titanate ($Bi_2Ti_2O_7$), and mixtures thereof is present in parts by weight between 0.1 and 5%, wherein the total content of oxide in parts by weight is about 20% maximum.

2. A sinter contact material according to claim 1 wherein said member selected from the group consisting of bismuth zirconate, bismuth titanate, and mixtures thereof is present partially as a mixed oxide or as a stoichiometric compound.

3. A sinter contact material according to claim 1 wherein said member selected from the group consisting of bismuth zirconate, bismuth titanate, and mixtures thereof is present in parts by weight between 0.5 and 4%.

4. A sinter contact material according to claim 3 wherein said member selected from the group consisting of bismuth zirconate, bismuth titanate, and mixtures thereof is present in parts by weight between 0.5 and 3%.

5. A sinter contact material according to claim 1 wherein the content of all oxides in parts by weight is about 12%.

6. A sinter contact material according to claim 4 wherein the content of all oxides in parts by weight is about 12%.

7. A sinter contact material according to claim 5 wherein the content of all oxides in parts by weight is about 12%.

* * * * *